US007086126B2

(12) United States Patent
English

(10) Patent No.: US 7,086,126 B2
(45) Date of Patent: Aug. 8, 2006

(54) ELASTIC BAND WITH SNAP-BUCKLES FOR HOLDING GARMENT WAISTBAND

(75) Inventor: Thomas P. English, Honolulu, HI (US)

(73) Assignee: Speaks, Inc., Honolulu, HI (US)

( * ) Notice: Subject to any disclaimer, the term of this patent is extended or adjusted under 35 U.S.C. 154(b) by 101 days.

(21) Appl. No.: 10/909,193

(22) Filed: Jul. 30, 2004

(65) Prior Publication Data

US 2006/0021202 A1 Feb. 2, 2006

(51) Int. Cl.
*A44B 11/25* (2006.01)
*A44B 21/00* (2006.01)
*A41F 1/00* (2006.01)

(52) U.S. Cl. ..... 24/301; 24/668; 2/237

(58) Field of Classification Search ..... 24/300, 24/301, 200, 668, 182; 2/237, 221, 321, 2/322

See application file for complete search history.

(56) References Cited

U.S. PATENT DOCUMENTS 775,587 A * 11/1904 Tooker et al. ..... 2/326
806,598 A * 12/1905 Stokes ..... 24/301
863,716 A * 8/1907 Hunter ..... 2/237
2,607,975 A * 8/1952 Telles ..... 24/163 R
3,911,537 A * 10/1975 Mazur ..... 24/668
6,226,845 B1 * 5/2001 Fink ..... 24/668

OTHER PUBLICATIONS

Dritz Overall Buckle, product brochure, Jun. 2004.

* cited by examiner

*Primary Examiner*—Robert J. Sandy
(74) *Attorney, Agent, or Firm*—Leighton K. Chong; Godbey Griffiths Reiss & Chong

(57) ABSTRACT

A device, for holding a garment waistband, has a flat, elongated elastic band stretchable across two belt loops, and a pair of fastener components formed by metal wire bent to form a back bar for the elastic-band-mounting end and a hook-loop fastener end for hooking onto a post member mounted to the elastic band. The back bar is formed in a thin channel shape defining a concave cross-sectional gap with a thickness such that it can be seated around the exposed length of the belt loop and clasp it by its thickness. The device provides the wearer with a slimmer profile and is more comfortable to wear than a waist-length belt. The back bar may be formed with bar halves separated by a cut-away gap to allow the elastic band to be sleeved on and off, to interchange elastic bands and/or other decorative fastener components.

16 Claims, 4 Drawing Sheets

ELASTIC BAND WITH SNAP-BUCKLES FOR HOLDING GARMENT WAISTBAND

TECHNICAL FIELD

This invention generally relates to an attractive, decorative, and comfortable-to-wear device for holding a garment waistband.

BACKGROUND OF INVENTION

The waistband of pants, skirts, shorts, and other garments typically has a number of belt loops sewn or attached at intervals around its circumference, through which a belt is inserted and attached by its ends with a buckle at the front of the waistband. For many wearers, having to purchase and maintain many belts of different types, colors, and styles to go with different colors and combinations of clothes can be costly and inconvenient. A waist circumference-length belt requires the use of a considerable amount of expensive material, such as conditioned and sewn leather, and its original color and style cannot be readily changed after purchase. Many wearers also find the bulk of the typical belt and the tension applied around the waist to be unaesthetic for a slim profile and slightly uncomfortable to wear. Particularly for teenage girls and young women, the typical belt is an accessory that does readily allow the wearer to interchange colors, styles, textures, and/or ornamental appearance.

It would be very desirable to have a belt-like device that is inexpensive, can be worn comfortably and with a slim profile, and allows the wearer the option to readily change its color, style, texture, and/or appearance.

SUMMARY OF INVENTION

In accordance with the present invention, a device, for holding a garment waistband of the type provided with belt loops attached at spaced intervals thereon, comprises:

- a flat, elongated elastic band having a predetermined length between opposing ends thereof and being made of an elastic material which is stretchable with a slight tension to an expanded length approximately equal to the interval across two belt loops along the garment waistband;
- a pair of fastener components, each fastener component having a first member which has a fastener end and an opposite elastic-band-mounting end that is attachable to a respective end of the elastic band, said elastic-band-mounting end being configured to be seated around an exposed length of a respective one of the two belt loops, and a second member having an anchor end on a back side thereof that is anchored to an intermediate portion of the elastic band and a post end projecting a slight distance to a front side from the elastic band which is adapted to be engaged by the fastener end of the first member,
- whereby the elastic band can be attached to hold the garment waistband by stretching it and seating the elastic-band-mounting ends of the first members of the fastener components around the exposed lengths of the respective belt loops and then attaching the fasteners ends of the first members to the projecting post ends of the second members.

In the preferred embodiments of the invention, the first members of the fastener components are snap-buckles formed by a metal wire of substantial rigidity that is bent into a symmetrically curved shape forming a bent back bar for the elastic-band-mounting end and a hook-loop fastener end which hooks onto the projecting post end of the second member. The bent back bar of the elastic-band-mounting end has a concave cross-section for clasping onto the thickness of the belt loop. The fastener component can be readily formed from the conventional type of snap-buckle on riveted post typically used for attaching the ends of suspenders to jeans overalls. The free end of the conventional snap-buckle can simply be bent back to form the elastic-band-mounting end of the fastener component with a thin channel shape of concave cross-section defining a gap between its open ends slightly greater than the thickness of the elastic band combined with the thickness of typical fabric belt loop, i.e., about 3 mm to 4 mm thickness. In this manner, the channel shape can be seated around the exposed length of the belt loop and clasp it by its thickness between the attached elastic band at the back side and the fastener component at the front side thereof.

The clasping of the exposed length and thickness of the belt loop serves to distribute the pulling tension of the elastic band along the length of the belt loop and avoid distorting its shape when the device is worn on the belt loops of the garment waistband. This enhances both the aesthetic appearance of the device and the comfort of the wearer. The device may be worn across the front belt loops or any combination of side or back belt loops according to fashion. As the device is worn across only two belt loops, instead of the circumference of the waist, it provides the wearer with a slimmer profile and is more comfortable to wear.

As an interchangeable version of the device, the back bar for holding the end of the elastic band can have a cut-away gap to allow a stitched tubular end of the elastic band to be readily sleeved on and off the back bar halves, in order to allow the wearer to interchange elastic bands of different colors and styles and/or snap-buckles. This allows the device combination to be marketed in various product configurations, such as pairs of decorative snap buckles sold separately as decorative accessories, sets of elastic bands of different colors, textures, or styles, and elastic bands for different waistband widths, belt loop spacings, and/or wearing on the front belt loops or side or back belt loops. The snap buckles may be sold in various arrangements of decorative front plate, or with attachable chains, jewelry, charms, or other decorative elements to enhance the aesthetic appearance of the device.

Other objects, features, and advantages of the present invention will be explained in the following detailed description of the invention having reference to the appended drawings.

DETAILED DESCRIPTION OF INVENTION

Figure 1:
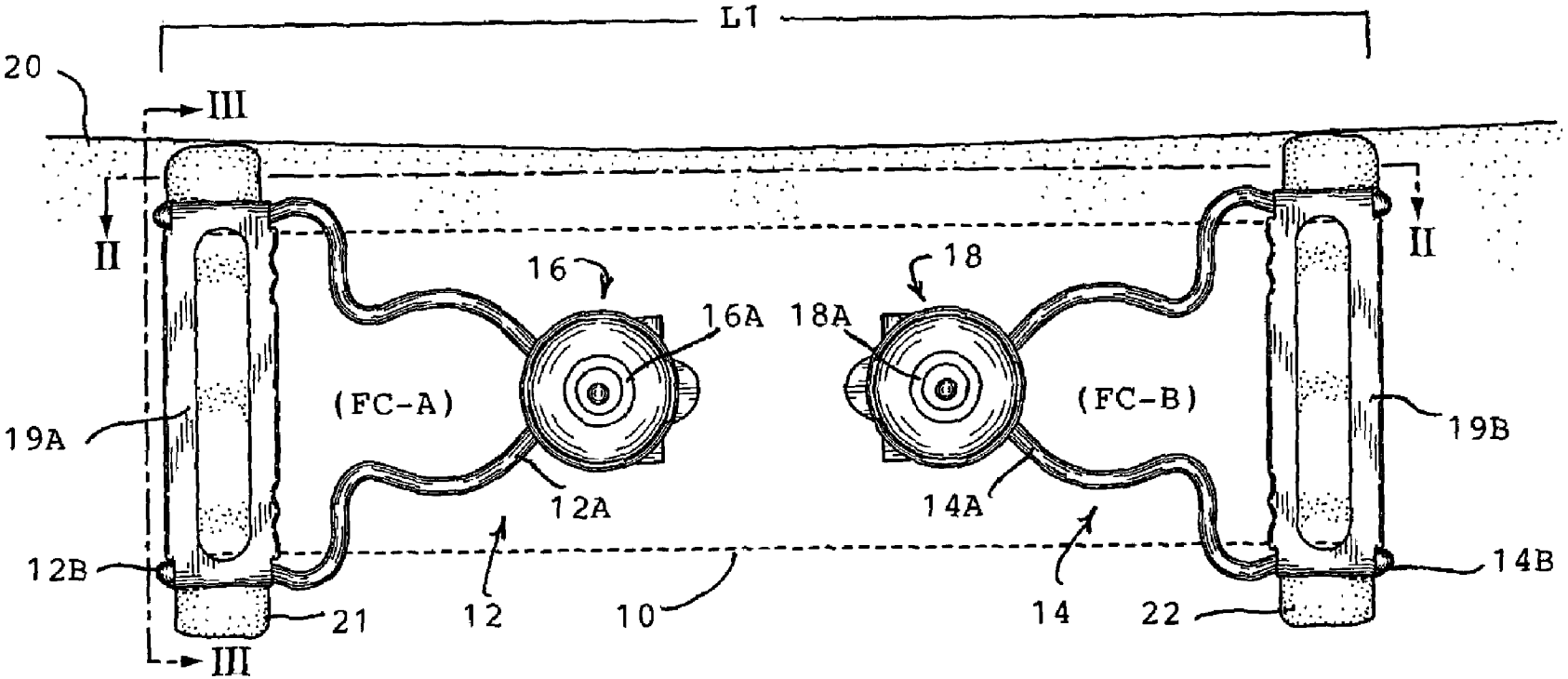
FIG. 1 shows a front view of one embodiment of the belt-like device having an elastic band and pair of fastener components worn across two belt loops of a garment waistband.

Referring to FIG. 1, device for holding a garment waistband 20 is shown having a flat, elongated elastic band 10, which is stretched across two belt loops 21, 22 sewn or otherwise attached at an interval L1 on the waistband 20, and a pair of (left and right) fastener components FC-A, FC-B attached to the ends of the elastic band 10 which are secured around the belt loops and fastened to an intermediate portion of the elastic band. Each fastener component FC has a first member 12, 14, formed with a fastener end 12A, 14A, and an opposite elastic-band-mounting end 12B, 14B, that is attached to a respective end of the elastic band. The elastic-band-mounting end is configured to be seated around an exposed length of a respective one of the belt loops. A second member 16, 18, of the fastener component FC is formed with an anchor end 16B, 18B (not visible in this figure), that is anchored to the intermediate portion of the elastic band, and a post end 16A, 18A, projecting a slight distance toward the front of the elastic band where it is engaged by the fastener end 12A, 14A, of the first member 12, 14. A decorative front plate 19A, 19B, may be mounted on the front side of the fastener component FC-A, FC-B, and may have a slot therein to expose the belt loop and allow the wearer to visually check that the fastener component is properly seated around the belt loop.

Figure 2:
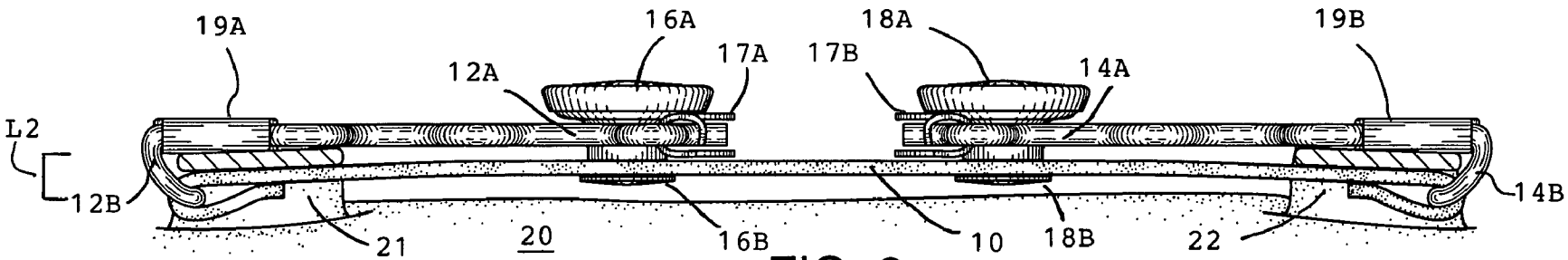
FIG. 2 shows a top or bottom elevation view of the device, taken along view lines II—II in FIG. 1.
Figure 3:
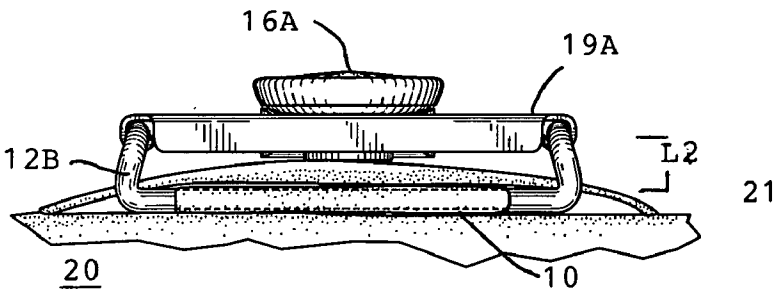
FIG. 3 shows a side elevation view of the device, taken along view lines III—III in FIG. 1.

Referring in more detail to FIGS. 2 and 3, the elastic band 10 is formed with a predetermined length somewhat less than the interval L1 across the two chosen belt loops 21, 22. For example, in a typical garment waistband, the front two belt loops are at quarter positions to each side of the front centerline, analogous to +45 degrees and −45 degrees on the circumference of a circle. Therefore, the front belt loop interval L1 is typically one-quarter of the circumference of the waistband. For waist sizes of 20–24 inches (U.S. size measurements), the front belt loop interval L1 would be about 5–6 inches, hence an elastic band length of less than 5 inches, e.g., 4.75 inches, might be used. Similarly, for waist sizes of 24–28 inches, an elastic band length of 5.75 inches may be used, and for waist sizes of 28-32 inches, an elastic band length of 6.75 inches may be used. With typical woven elastic stretch fabric, even a stretch of 1.25 inches would still be comfortable for the wearer. The device of the present invention may be worn on two side or back belt loops, or any combination of two belt loops, according to fashion, or may even be worn on other garments that have a pair of belt loops, for example, a waist coat, cut-off jacket, etc. In each case, the elastic band and fastener components can be sized, configured, and decorated according to fashion.

Preferably, the first members 12, 14, of the fastener components are formed as snap-buckles made of metal wire of substantial rigidity that is bent into a symmetrically curved shape to form back bars for the elastic-band-mounting ends 12B, 14B, and terminate in the fastener ends 12A, 14A. The elastic-band-mounting ends 12B, 14B, have the back bar bent over to form a thin channel of concave cross-section. The elastic band 10 is attached to the back bar by folding it over at the ends and sewing a stitch line to form a tunnel that is sleeved over the back bar. The concave cross-section of the back bar is configured to form a gap L2 between its open ends which is slightly greater than the thickness of the elastic band combined with the thickness of a typical fabric belt loop, i.e., about 3 mm to 4 mm thickness. In this manner, when the elastic-band-mounting end 12B, 14B, is seated around the thickness of the belt loop, it holds and clasps the exposed length of the belt loop by its thickness between the attached elastic band at the back side and the fastener component at the front side thereof. The fastener ends 12A, 14A, are formed by shaping the metal wire to form a narrowed neck which fits with an interference fit (snaps) onto the outer diameter of the post end 16A, 18A, of the second member 16, 18. The post end may have a larger-diameter button on the front end thereof as a decorative element. The metal wire is formed with enlarged loop bends to fit over the button and allow the fastener end to be snap-hooked onto the post end. An end clip 17A, 17B, is bent back and clamped to the ends of the metal wire to hold them together and to center the fastener ends on the post end without any slack.

The fastener component can be readily formed from the conventional type of snap-buckle and rivet post with button top typically used for attaching the ends of suspenders to jeans overalls. Such overall buckles and rivet buttons are available commercially, for example, from the Prym-Dritz Corporation, of Spartanburg, S.C. The free end of the conventional snap-buckle can simply be bent back to form the back bar of the elastic-band-mounting end of the fastener component.

To use the device, the ends of the fastener components are inserted through the insides of the two chosen belt loops and the elastic band is stretched to the length (L1) of the interval across the belt loops. The elastic-band-mounting ends 12B, 14B, of the fastener components are then doubled over and seated onto the exposed lengths of the belt loops, and the fastener ends 12A, 14A, are slipped over and snap-hooked onto the post ends of the riveted second members on the intermediate portion of the elastic band.

The stretching of the elastic band provides a slight tension that sufficiently holds the garment waistband on the wearer. Since the device is worn only across two belt loops, it provides a slimmer profile for the wearer and is more comfortable to wear, in contrast to wearing a belt around the circumference of the waist. The clasping of the exposed length and thickness of the belt loops serves to distribute the pulling tension of the elastic band 10 along the length of the belt loops. This avoids distorting their shape when the device is worn, and enhances both the aesthetic appearance of the device and the comfort of the wearer.

Figure 4:
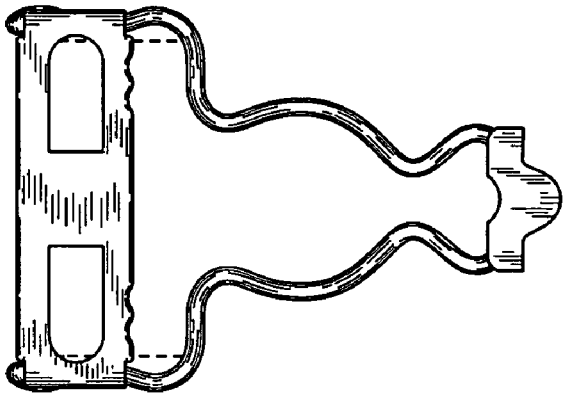
FIG. 4 shows a front view of another embodiment of the fastener component allowing interchangeability of elastic band and fastener components.
Figure 7B:
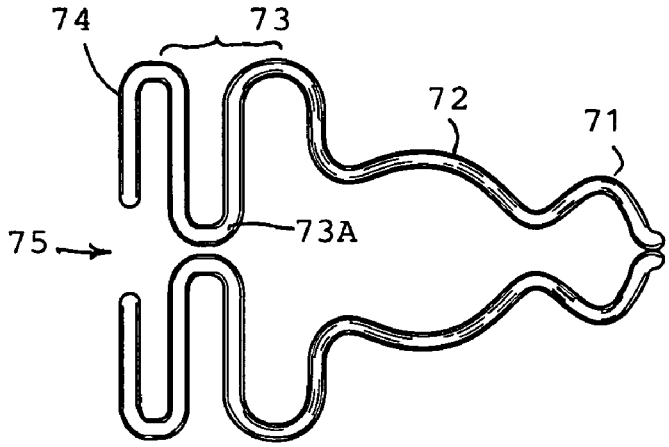
FIG. 7B shows metal wire elements used to from the fastener component.
Figure 7A:
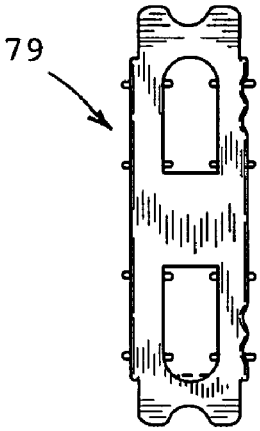
FIG. 7A shows a decorative front plate mounted on the device.
Figure 7C:
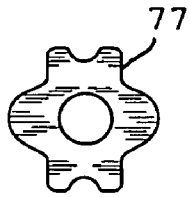
FIG. 7C shows the assembly of the fastener component.
Figure 5:
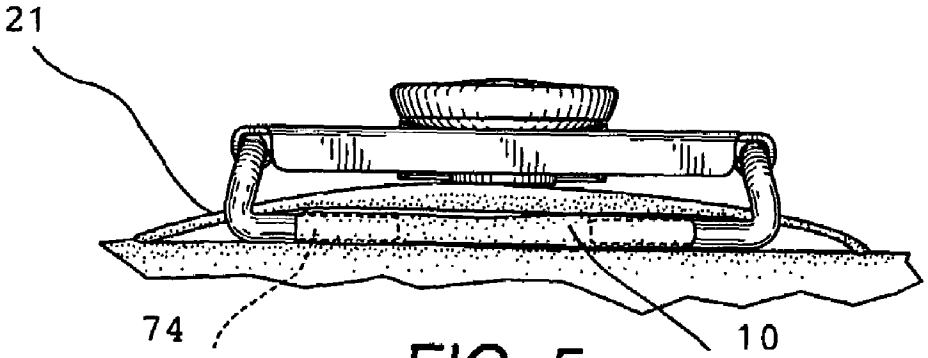
FIG. 5 shows a side elevation view of the second embodiment of the fastener component having a cut-away gap for sleeving a tubular ends of the elastic band on and off.
Figure 6:
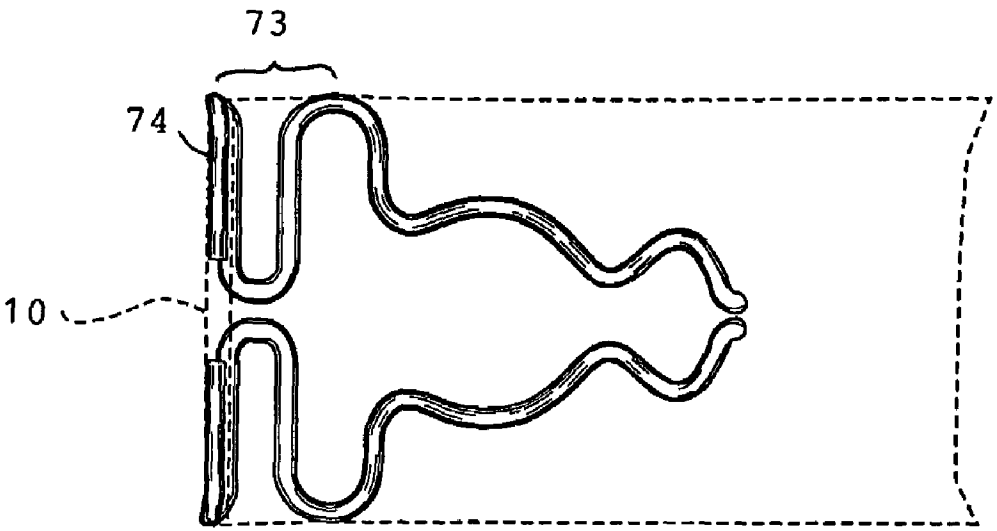
FIG. 6 shows a back side view of the second embodiment of the fastener component.

Referring to FIGS. 4–7, another embodiment of the device is shown for allowing the elastic band and fastener components to be readily interchanged. In FIG. 7B, a pair of metal wire segments for forming the fastener component has an end loop 71 for snap-hooking onto the rivet post end, an enlarged loop 72 for fitting over the decorative button on the post end, a zig-zag loop 73 for forming a mid-section support bar 73A, and a back bar 74 for holding the elastic band end. A cut-away gap 75 is formed between the back bar halves 74 of the metal wire segments to allow the tunnel ends of the elastic band to be sleeved on and off the back bar halves for interchangeability. A decorative front plate 79, as shown in FIG. 7A, is attached over the zig-zag loops 73 of the fastener component using small clips distributed around its periphery. The front plate 79 serves to brace the zig-zag loops and mid-section support bars 73A in one plane for torsional rigidity, since the back bar halves have the cut-away gap, instead of the continuous bar in the first embodiment. The metal wire ends of the end loops 71 are clamped together by bending back and press-fitting the clip element 77 shown in FIG. 7C. The fully assembled fastener component is shown in FIG. 4. In FIG. 5, the use of the cut-away gap to sleeve on the elastic band 10 on the back bar halves 74 is illustrated. In FIG. 6, the bending back of the back bar halves for mounting the elastic band 10 is illustrated.

The second embodiment of the fastener component with cut-away gap allows the device to be marketed in various product configurations of the interchangeable parts. The pairs of decorative snap buckles may be sold separately as decorative accessories. Elastic bands may be sold in sets of different colors, textures, or styles. Elastic bands may be sold in progressive sizes (Short, Medium, Long) or widths to accommodate different waistband sizes, belt loop spacings, and/or wearing on the front, side or back belt loops. The snap buckles may be sold in various arrangements of decorative front plate, or attachable chains, jewelry, charms, or other decorative elements to enhance the aesthetic appearance of the device. The elastic bands may be offered in different materials, styles, or textures, such as braided, knitted or woven stretch fabric, and may come in lengths, e.g., from 4.75 to 6.75 inches, and different widths, e.g., from 0.75 to 2.0 inches.

It is understood that many modifications and variations may be devised given the above description of the principles of the invention. It is intended that all such modifications and variations be considered as within the spirit and scope of this invention, as defined in the following claims.

The invention claimed is:

1. A device for holding a garment waistband of the type having at least two belt loops attached at a spaced interval thereon, comprising:

a flat, elongated elastic band having a predetermined length between opposing ends thereof and being made of an elastic material which is stretchable with a slight tension to an expanded length approximately equal to the interval across the two belt loops on the garment waistband;

a pair of fastener components, each fastener component having a first member which has a fastener end and an opposite elastic-band-mounting end that is attachable to a respective end of the elastic band, said elastic-band-mounting end being configured to be seated around an exposed length of a respective one of the two belt loops, and a second member having an anchor end on a back side thereof that is anchored to an intermediate portion of the elastic band and a post end projecting a slight distance to a front side from the elastic band which is adapted to be engaged by the fastener end of the first member, whereby the elastic band can be attached to hold the garment waistband by stretching it and seating the elastic-band-mounting ends of the first members of the fastener components around the exposed lengths of the respective belt loops and then attaching the fasteners ends of the first members to the projecting post ends of the second members, and wherein said first members of the fastener components are snap-buckles formed by a metal wire of substantial rigidity that is bent into a symmetrically curved shape with a bent back bar on the elastic-band-mounting end, and a hook-loop fastener end which hooks onto the projecting post end of the second member, and wherein said back bar of the elastic-band-mounting end has a concave cross-section defining a gap between its open ends for clasping onto the thickness of the belt loop.

2. A device for holding a garment waistband according to claim 1, wherein said back bar of the elastic-band-mounting ends has a concave cross-section gap of about 3 mm to 4 mm thickness.

3. A device for holding a garment waistband according to claim 1, wherein said elastic-band-mounting ends of said fastener components are configured with means for allowing the interchanging of the elastic band and fastener components.

4. A device for holding a garment waistband according to claim 3, wherein the pair of fastener components is provided separately as an interchangeable decorative accessory.

5. A device for holding a garment waistband according to claim 1, further comprising means for attaching a decorative element to the elastic band and/or fastener components.

6. A device for holding a garment waistband of the type having at least two belt loops attached at a spaced interval thereon, comprising:

a flat, elongated elastic band having a predetermined length between opposing ends thereof and being made of an elastic material which is stretchable with a slight tension to an expanded length approximately equal to the interval across the two belt loops on the garment waistband;

a pair of fastener components, each fastener component having a first member which has a fastener end and an opposite elastic-band-mounting end that is attachable to a respective end of the elastic band, said elastic-band-mounting end being configured to be seated around an exposed length of a respective one of the two belt loops, and a second member having an anchor end on a back side thereof that is anchored to an intermediate portion of the elastic band and a post end projecting a slight distance to a front side from the elastic band which is adapted to be engaged by the fastener end of the first member, whereby the elastic band can be attached to hold the garment waistband by stretching it and seating the elastic-band-mounting ends of the first members of the fastener components around the exposed lengths of the respective belt loops and then attaching the fasteners ends of the first members to the projecting post ends of the second members, and wherein said first members of the fastener components are snap-buckles formed by a metal wire of substantial rigidity that is bent into a symmetrically curved with a bent back bar on the elastic-band-mounting end, and a hook-loop fastener end which hooks onto the projecting post end of the second member, and, wherein said back bar is formed with back bar halves separated by a cut-away gap to allow a stitched tubular end of the elastic band to be sleeved on and off for interchangeability.

7. A device for holding a garment waistband according to claim 6, wherein said fastener components are formed with zig-zag loops forming mid-section support bars, and a decorative front plate is attached over the zig-zag loops to brace the zig-zag loops and mid-section support bars in one plane for torsional rigidity.

8. A device for holding a garment waistband according to claim 6, wherein the elastic band is provided with means for attaching an interchangeable decorative accessory.

9. A device for holding a garment waistband of the type having at least two belt loops attached at a spaced interval thereon, comprising:

a flat, elongated elastic band having a predetermined length between opposing ends thereof and being made of an elastic material which is stretchable with a slight tension to an expanded length approximately equal to the interval across the two belt loops on the garment waistband;

a pair of fastener components, each fastener component having a first member which has a fastener end and an opposite elastic-band-mounting end that is attachable to a respective end of the elastic band, said elastic-band-mounting end being configured to be seated around an exposed length of a respective one of the two belt loops, and a second member having an anchor end on a back side thereof that is anchored to an intermediate portion of the elastic band and a post end projecting a slight distance to a front side from the elastic band which is adapted to be engaged by the fastener end of the first member, whereby the elastic band can be attached to hold the garment waistband by stretching it and seating the elastic-band-mounting ends of the first members of the fastener components around the exposed lengths of the respective belt loops and then attaching the fasteners ends of the first members to the projecting post ends of the second members, and further comprising a decorative front plate attached to a front side of the fastener component over the position of the belt loop and having a slot to expose the belt loop therethrough.

10. A device for holding a garment waistband according to claim 9, further comprising means for attaching a decorative element to the elastic band and/or fastener components.

11. A fastener component, for use in a pair for attachment to two opposing ends of an elastic band for holding a garment waistband by stretching across a pair of belt loops of a given thickness attached at a spaced interval on the garment waistband, comprising:

a first member having a fastener end and an opposite elastic-band-mounting end that is attachable to a respective end of the elastic band, said elastic-band-mounting end being configured to be seated around an exposed length of the belt loop, and a second member having an anchor end on a back side thereof that is to be anchored to an intermediate portion of the elastic band and a post end projecting a slight distance to a front side of the elastic band which is adapted to be engaged by the fastener end of the first member, wherein said first member is formed by a metal wire of substantial rigidity that is bent to form a back bar in a thin channel shape defining a concave cross-sectional gap for seating around the thickness of the belt loop at the elastic-band-mounting end, and also bent to form a hook-loop fastener end which extends at a front side of the elastic band to hook onto the projecting post end of the second member, and whereby the fastener component allows the elastic band to be attached to the garment waistband by stretching and seating the elastic-band-mounting end of the first member around the exposed length of a respective one of the pair of belt loops and clasping it by its thickness, and then attaching the fastener end of the first member to the projecting post end of the second member.

12. A fastener component according to claim 11, wherein said back bar of the elastic-band-mounting end defines a concave cross-sectional gap equal to about the thickness of the elastic band combined with the thickness of the belt loop.

13. A fastener component according to claim 11, wherein said back bar of the elastic-band-mounting end defines a concave cross-sectional gap of about 3 mm to 4 mm thickness.

14. A fastener component according to claim 11, wherein said back bar is formed with back bar halves separated by a cut-away gap to allow a stitched tubular end formed on the elastic band to be sleeved on and off the back bar halves for interchangeability.

15. A fastener component according to claim 11, formed with zig-zag loops forming mid-section support bars, wherein a decorative front plate is attached over the zig-zag loops to brace the zig-zag loops and mid-section support bars in one plane for torsional rigidity.

16. A fastener component according to claim 11, further comprising a decorative front plate attached to a front side of the fastener component over the position of the belt loop and having a slot to expose the belt loop therethrough.

* * * * *